United States Patent [19]

Cook

[11] 4,126,261

[45] Nov. 21, 1978

[54] DISPOSABLE FOOD TRAY WITH CONDIMENT CONTAINER

[76] Inventor: Lon S. Cook, P.O. Box 206, Oroville, Wash. 98844

[21] Appl. No.: 844,972

[22] Filed: Oct. 25, 1977

[51] Int. Cl.[2] ..... B65D 5/48

[52] U.S. Cl. ..... 229/15; 206/561

[58] Field of Search ..... 220/23.8; 206/557, 561, 206/565; 229/32, 15, 1.5 B

[56] References Cited

U.S. PATENT DOCUMENTS

| | | | |
|---|---|---|---|
| 1,296,786 | 3/1919 | Fermier | 229/1.5 B |
| 1,955,663 | 4/1934 | Wendell et al. | 229/32 |
| 2,127,631 | 8/1938 | Nagle | 229/1.5 B X |
| 3,442,435 | 5/1969 | Ludder et al. | 229/15 |
| 3,721,380 | 3/1973 | Meyers | 229/15 |

*Primary Examiner*—Davis T. Moorhead

[57] ABSTRACT

A semi-rigid box like disposable food tray for the take out food industry that is provided with one or more associated condiment containers to allow service of food and condiments in one container but in a separated state. The condiment containers are foldably extensible from the food tray at the time of use to allow container stacking before use.

4 Claims, 9 Drawing Figures

DISPOSABLE FOOD TRAY WITH CONDIMENT CONTAINER

BACKGROUND OF INVENTION

1. Related Applications

There are no applications related hereto now filed in this or any foreign country.

2. Field of Invention

My invention relates generally to compartmentalized receptacles and more particularly to a disposable prepared food tray having one or more associated condiment compartments.

3. Description of Prior Art

The take out prepared food industry has developed the practice of merchandising foods in disposable containers, principally of a tray-like configuration and a semi-rigid structure, generally formable in some economic fashion from sheet materials, such as plastic or paper. Oftentimes it is desirable to merchandise some sort of condiment or sauce with the principal comestible, and this commonly has been done as in the case of salt and pepper with many foods, catsup with french fries, mustard with hamburgers, tartar sauce with fish, and the like. Because of consumer preference and the aesthetics of flavor and texture, condiments and sauces have commonly been supplied in separate containers or in some other manner of physical separation from the principal comestible. The primary method of so doing at the present time is to separately package the sauce or condiment in an independent package that is in no way necessarily associated with the container for the principal comestible.

A second and at present lesser used method of merchandising such condiments is by means of a container or compartment physically associated with the container for the principal comestible. Various compound containers of this type have heretofore become known and it is with this class of container that the instant invention is concerned.

Primary containers having ancillary structures defining smaller compartments for secondary containers have heretofore become known. Such containers generally have been created for a specific purpose and their structure has been necessarily dictated by that purpose and essentially related to it. The instant invention differs from this art in providing at least one auxiliary container formed essentially separately rather than as a compartment or part of the principal container structure so that it may be formed of materials different from those of the primary container structure to more effectively fulfill its purpose and provide for greater economy as it is oftentimes necessary to provide a specialized, more costly material for containment of condiments than is required for containment of some principal comestible. The instant invention further differs from the prior art in providing a secondary container that is structurally carried by the principal container so that the secondary container may not be accidentally dislodged from its support but yet it is configured as a foldable structure that may be positioned immediately adjacent the principal container walls for storage and opened for condiment containment at the time of use. The instant invention further differs from the prior art in providing a structure that is economically formed from semi-rigid sheet materials in a fashion that is most economic and provides a minimum amount of bulk all to make the container readily adaptable as a throw-away type expendable container in the prepared food industry. Several, if not all of these features have become known per se, in their essence at least, in the prior art, but none of that prior art discloses all of the elements in the particularization or the single compartment as in the instant invention.

SUMMARY OF INVENTION

My invention provides generally a principal comestible container with at least one structurally associated similar condiment container.

The principal comestible container is formed of semi-rigid material to the configuration of an open topped stackable container, with outwardly flaring sides and appropriate dimension. The principal container supports at least one auxiliary condiment container. The condiment container is smaller than the principal container and formed with at least one surface of substantial area to fit in adjacency with the principal container and be joined thereto by mechanical attachment. The condiment container provides an open topped receptacle formed with foldable elements so as to be foldable flatly adjacent the principal container and yet be openable away therefrom to allow convenient container storage by traditional stacking methods. Both the principal container and ancillary condiment container may be formed from folded, die-cut sheet stock with various portions joined by traditional fastening means.

In creating such a compound container it is:

A principal object of my invention to provide a disposable type comestible container for food supporting at least one smaller ancillary condiment container.

A further object of my invention to provide such a container wherein the ancillary condiment container may be formed of material different from the comestible container.

A still further object of my invention to provide such a container wherein the condiment container is foldable to allow it to flatten immediately adjacent the supporting principal container for storage and yet open readily for use.

A still further object of my invention to provide such a comestible container that supports at least one ancillary condiment container within the containment space defined by the comestible container.

A still further object of my invention to provide such a container that is of new and novel design, of rugged and durable nature, of simple and economic manufacture and otherwise well suited to the uses and purposes for which it is intended.

Other and further objects of my invention will appear from the following specifications and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

My invention consists generally of principal comestible container 10 structurally supporting at least one ancillary condiment container 11 in its peripherally defined comestible carrying space.

Figure 1:
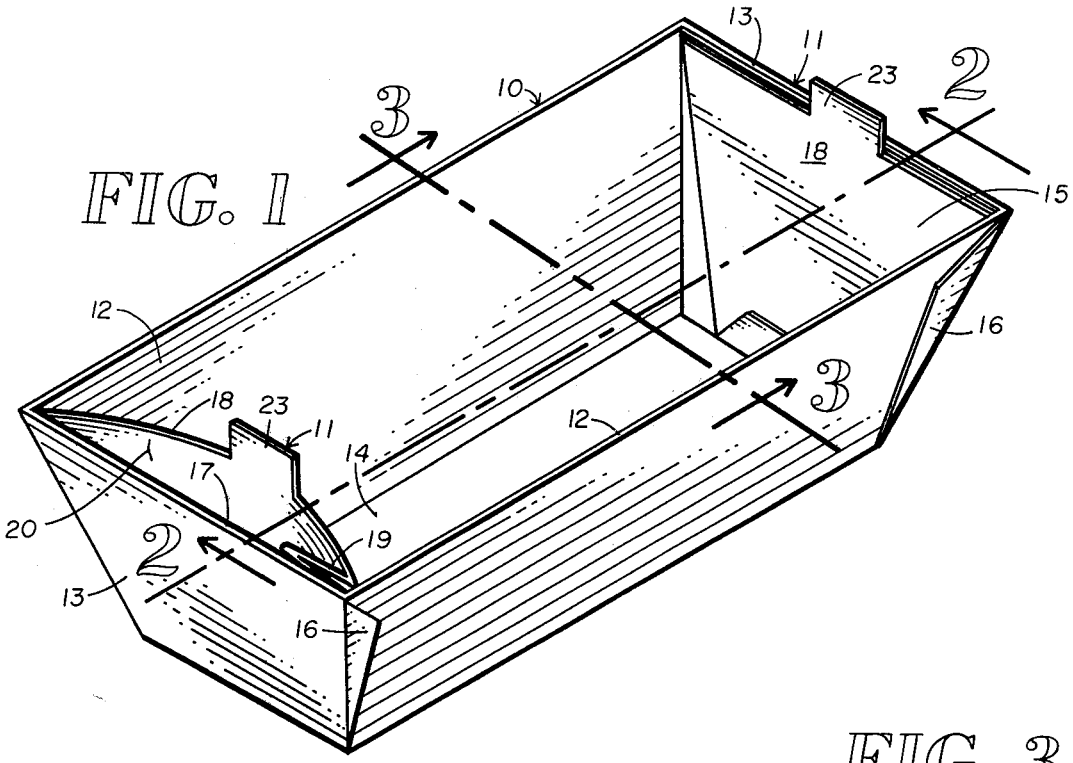
FIG. 1 is a downward looking isometric view of the principal form of my container showing its various parts, their configuration and relationship.
Figure 2:
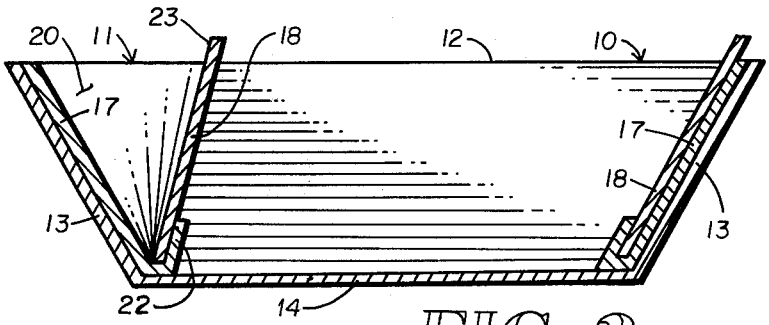
FIG. 2 is a lengthwise, vertical cross-sectional view of the container of FIG. 1, taken on the line 2—2 thereon in the direction indicated by the arrows, to show in more detail the structure of the device.
Figure 3:
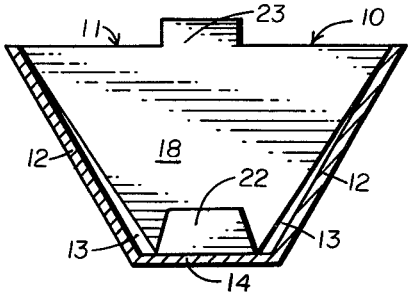
FIG. 3 is a transverse vertical cross-sectional view of the container of FIG. 1, taken on the line 3—3 thereon in the direction indicated by the arrows.

Principal comestible container 10 is a box-like structure as illustrated in FIG. 1, with similar opposed sides 12 joined by paired opposed ends 13, and planar bottom 14 all interconnected at adjoining edges to peripherally define chamber 15 for containment of some principal comestible product. The particular rectilinear shape illustrated in FIG. 1 is common for such containers, but they may have a curvilinear shape defining some sort of a closed circle-like curve in cross-section. Commonly such containers are provided with upwardly and outwardly flaring sides so that they may be attached for simple, convenient, low volume storage and transport and to provide a larger opening to thereby allow easy access to chamber 15.

Since this type of container is commonly disposable in the present day practice of prepared food merchandising, it is necessarily of an inexpensive construction. The use of the container also requires that it be formed of some at least semi-rigid material to fulfill its containment function and this material must be of a nature compatible for the containment of edible foodstuffs. These requirements have commonly caused such containers to be formed of sheet plastic or paper, in the latter case generally a paper coated or impregnated with resin, wax or plastic material to aid containment of liquid and greases.

Figure 5:
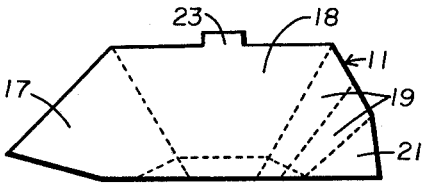
FIG. 5 is the flat pattern of the ancillary condiment container of FIG. 1, with potential fold lines shown by dotted lines.

A pattern for the typical container illustrated is shown in FIG. 5. This particular pattern provides connecting flaps 16 carried by the vertical side portion of ends 13 to fit on the adjacent part of sides 12 for structural joinder thereto commonly by adhesion. This particular configuration or principal comestible container is common in the prior art because of its convenient shape and maximization of the use of sheet material from which it is formed.

This type of principal comestible container described is not new per se and the structures and methods of formation are well known in the prior art.

Figure 6:
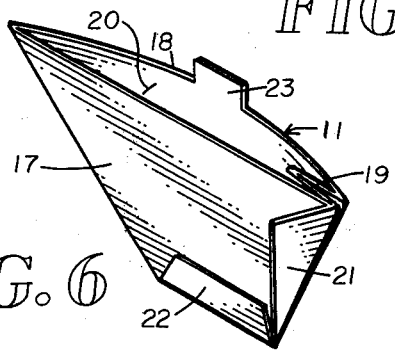
FIG. 6 is an isometric view of the ancillary condiment container formed from the pattern of FIG. 5 and before joinder upon the principal comestible container.
Figure 4:
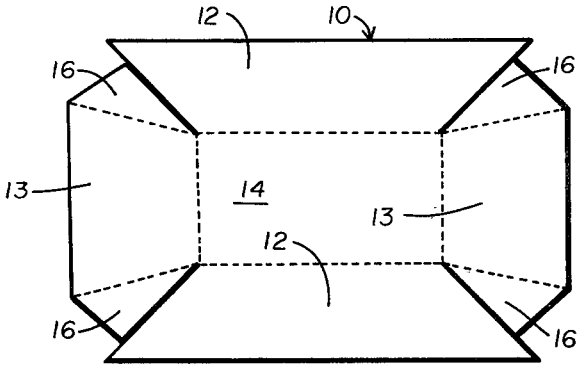
FIG. 4 is the flat pattern of the principal container of my invention with potential fold lines shown by dotted lines.

The primary form of ancillary condiment container 11 is illustrated bestly in FIGS. 5 and 6 where it is seen to provide a wedge shaped peripheral structure comprising triangular back 17, front 18 and folded element 19, all joined at their abutting edges to define inverted pyramidal chamber 20 for condiment containment. A planar pattern for this ancillary condiment container is shown in FIG. 5, with potential fold lines shown in dotted lines. This form of ancillary condiment container provides side fastening flap 20 and bottom fastening flap 22 to be mechanically fastened to the adjacent portions of back 17 when the container is positioned as illustrated in FIG. 1. The joinder of the various parts of the condiment container and of condiment container with comestible container is preferably by adhesion. Other mechanical joinder such as by staples or rivets are operable but not preferred because of their additional cost, possible comestible contamination and requirement of holes through container walls.

The ancillary condiment container commonly will contain condiments of a liquid or semi-liquid nature that often comprise greases, fats and mild organic acids, and to contain such substances the structure is preferably formed of a material that is substantially impervious to these substances. Similarly, the structure must have some rigidity, and though its configuration aids the ultimate rigidity of the assembled structure, the material from which it is formed still must provide a part of that rigidity. Plastic or wax coated paper of appropriate substance ideally fulfills these requirements and it is readily commercially available in the present day food container art. Undoubtedly other materials of similar nature would be operative with my invention, and relatively thin semi-rigid sheets of plastic have been used, but these materials are more expensive than the treated paper product. Metal foils are operative and ideal for containment because of their impervious nature but generally are not desirable because of their relatively greater cost.

The shape of the ancillary condiment container is not critical to my invention so long as the containment chamber is defined by peripheral elements providing a surface adapted to fit in adjacency over a reasonable area with a part of the inner surface of the principal container, be joined thereto by merchanical means and be foldably collapsible substantially thereagainst for storage. Again, the sizing of the auxiliary condiment container is not critical, but all or a substantial part should be designed to fit within the principal comestible container and still leave a substantially greater volume for containment of comestible in the principal container when the condiment container is opened. These requirements are admirably met by the particular sizing and wedge-shaped configuration of condiment container illustrated, when used in conjunction with the type of principal comestible container illustrated.

Figure 7:
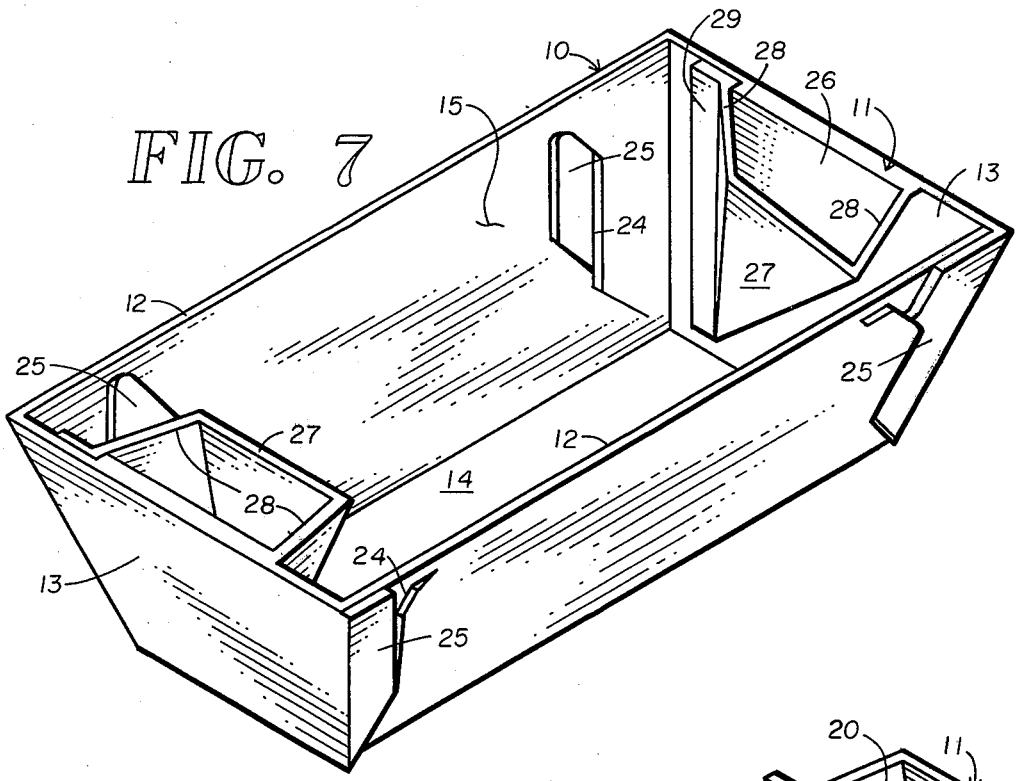
FIG. 7 is an isometric view of a species of my invention having releasably interlocking corners and a different form of foldable condiment container.
Figure 8:
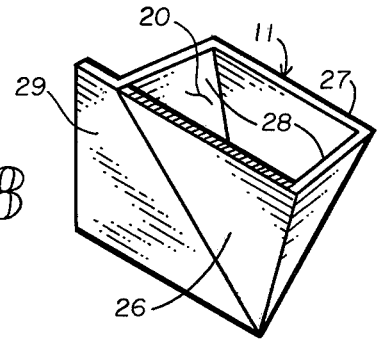
FIG. 8 is an isometric view of the condiment container of FIG. 7.

A species of my invention is shown in FIGS. 7 et seq. Here the principal comestible container is of substantially the same form as described for the primary species except for the fastening of connecting flaps 16 to sides 12. Here each of the connecting flaps are provided with slots 24 to retentively receive connector tabs 25 carried by each of the adjacent vertical edges of side 12 to releasably join these members. This structure per se is well known in the container arts.

Figure 9:
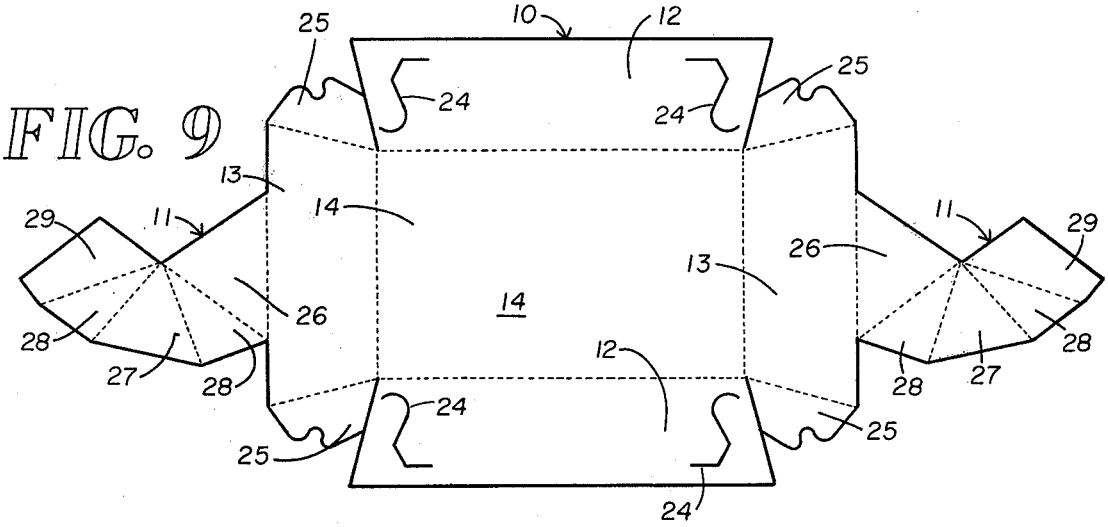
FIG. 9 is a pattern for the container of FIG. 7.

The principal difference in the species is the shape and formation of condiment container 11. This container is wedge shaped but formed with four side elements rather than three. It provides similar back 26 and front 27 joined by similar opposed sides 28 and fastening tab 29. At least two of this form of condiment container may be formed with the principal comestible container from one piece of material as illustrated in FIG. 9, if desired, or obviously one container may be formed separately and mechanically joined as before described.

Having thusly described the structure of my invention, its use may be readily understood.

The containers described and illustrated are formed according to my specification with one, two or more condiment containers as desired. If one or two condiment containers be used, they may be conveniently positioned in the ends of the principal container as illustrated in FIGS. 1 and 7 of the accompanying drawings. If more condiment containers should be desired, they may be positioned along the sides of the principal container. Upon formation the condiment containers are folded as flat as possible against the inner surface of the principal container and plural containers are stacked, fitting within each other, for convenient storage and transport. For use a single container is taken from the top of the stack and the condiment container is manually opened. Both principal container and condiment container are then filled with the respective products to be contained and the package is fully operative. The order of filling is not essential, but commonly it is more simple to fill the condiment containers before filling the principal comestible container, as quite commonly condiment containers will be formed of material not so rigid as that forming the principal container.

It should be noted from the foregoing description that my invention might quite readily be adapted for use with bucket type containers of circular or other curvilinear cross-section, without any material change in ancillary condiment container.

The foregoing description of my invention is necessarily of a detailed nature so that a specific embodiment of it might be set forth as required, but it is to be understood that various modifications of detail, rearrangement and multiplication of parts may be resorted to without departing from its spirit, essence or scope.

Having thusly described my invention, what I desire to protect by Letters Patent, and

What I claim is:

1. A disposable container for simultaneous separated containment of foods and condiments comprising, in combination:

a semi-rigid principal comestible container formed with a bottom structurally joining substantially upwardly extending sides to define a top opening containment space; and at least one foldable condiment container structurally carried on the inner surface of the upwardly extending sides of the principal comestible container and substantially within the containment space defined thereby, the condiment container having at least one foldable element configured to allow the container to fold into substantial adjacency with the principal comestible container wall but yet be manually openable away therefrom and into the containment space defined by the principal comestible container to define an open top condiment containment space.

2. The invention of claim 1 wherein the principal comestible container is configured with upwardly and outwardly flaring sides to define a chamber with smallest cross-section at the bottom so as to be stackable.

3. The invention of claim 1 further characterized by: the condiment container comprising trapazoidal side and back portions joined to each other along two adjacent edges, with two other non-connected edges joined by a triangular folded portion having at least one interconnecting fold to form an open top container.

4. The invention of claim 1 further characterized by: the condiment container comprising similar front and back parallelagrams joined along opposed parallel edges by similar triangular sides to define a wedge shaped open top container.

* * * * *